US012004615B2

(12) United States Patent
Poon

(10) Patent No.: US 12,004,615 B2
(45) Date of Patent: Jun. 11, 2024

(54) PROTECTIVE CASE FOR MOBILE ELECTRONIC DEVICE

(71) Applicant: Vinci Brands LLC, Tustin, CA (US)

(72) Inventor: Daniel Poon, Nashville, TN (US)

( * ) Notice: Subject to any disclaimer, the term of this patent is extended or adjusted under 35 U.S.C. 154(b) by 0 days.

(21) Appl. No.: 17/659,175

(22) Filed: Apr. 13, 2022

(65) Prior Publication Data

US 2022/0232938 A1 Jul. 28, 2022

Related U.S. Application Data

(63) Continuation-in-part of application No. 17/647,169, filed on Jan. 5, 2022, now abandoned, and a continuation-in-part of application No. 17/645,961, filed on Dec. 23, 2021, now abandoned, which is a continuation of application No. 17/399,046, filed on Aug. 10, 2021, now abandoned, said application No. 17/647,169 is a continuation of application No. 16/929,097, filed on Jul. 14, 2020, now abandoned, said application No. 17/399,046 is a continuation of application No. 16/786,974, filed on Feb. 10, 2020, now abandoned, which is a continuation-in-part of application No. 15/897,031, filed on Feb. 14, 2018, now abandoned, said application No. 16/929,097 is a continuation-in-part of application No. 15/068,868, filed on Mar. 14, 2016, now Pat. No. 10,709,220, said application No. 15/897,031 is a continuation of application No. 14/210,448, filed on Mar. 14, 2014, now Pat. No. 9,913,517.

(60) Provisional application No. 62/132,002, filed on Mar. 12, 2015, provisional application No. 61/782,110, filed on Mar. 14, 2013.

(51) Int. Cl.
*A45C 11/00* (2006.01)

(52) U.S. Cl.
CPC ..... *A45C 11/00* (2013.01); *A45C 2011/002* (2013.01)

(58) Field of Classification Search
CPC . G01F 1/1628; A45C 2013/025; A45C 13/02; A45C 11/00; A45C 2011/002; H04B 1/3888
USPC ..... 206/320, 38, 701, 316.1, 521, 576, 724, 206/45.2, 586; 224/191; 455/575.8, 455/575.1
See application file for complete search history.

(56) References Cited

U.S. PATENT DOCUMENTS 7,907,394 B2 * 3/2011 Richardson ..... G06F 1/1613 361/679.02
7,933,122 B2 * 4/2011 Richardson ..... H04B 1/3888 455/90.3
8,517,172 B1 * 8/2013 Chang ..... G06F 1/1626 206/320

(Continued)

*Primary Examiner* — Corey N Skurdal
(74) *Attorney, Agent, or Firm* — Umair A. Qadeer

(57) ABSTRACT

A protective case for a mobile electronic device having a touchscreen constructed from at least two separate frame components is disclosed herein. The frame components include a back frame and a front frame or cover. In some embodiments, when a mobile electronic device is held within the back frame, a stretchable cover is stretched over the back frame and device to securely hold the device within the back frame. The front frame or cover includes a touch-screen cover. The front frame or cover is removably coupled to the back frame with grasping protrusions or engagement members that engage with corresponding components of the back frame.

16 Claims, 18 Drawing Sheets

(56) References Cited

U.S. PATENT DOCUMENTS

| | | | | |
|---|---|---|---|---|
| 8,584,847 | B2 * | 11/2013 | Tages | G06F 1/1633 206/320 |
| 2012/0074005 | A1 * | 3/2012 | Johnson | H04B 1/3888 206/320 |
| 2013/0292269 | A1 * | 11/2013 | Tages | H05K 5/0086 206/37 |
| 2014/0204506 | A1 * | 7/2014 | Lin | G06F 1/1656 361/679.01 |

* cited by examiner

PROTECTIVE CASE FOR MOBILE ELECTRONIC DEVICE

CROSS-REFERENCE TO RELATED APPLICATIONS

This application is a continuation-in-part of U.S. patent application Ser. No. 17/645,961, filed on Dec. 23, 2021, which is a continuation of U.S. patent application Ser. No. 17/399,046, filed on Aug. 10, 2021, which is a continuation of U.S. patent application Ser. No. 16/786,974, filed on Feb. 10, 2020, which is a continuation-in-part of U.S. patent application Ser. No. 15/897,031, filed on Feb. 14, 2018, which is a continuation of U.S. patent application Ser. No. 14/210,448, filed on Mar. 14, 2014 and issued as U.S. Pat. No. 9,913,517 on Mar. 13, 2018, which claims the benefit of U.S. Provisional Patent Application Ser. No. 61/782,110, filed on Mar. 14, 2013; and this application is also a continuation-in-part of U.S. patent application Ser. No. 17/647,169, filed on Jan. 5, 2022, which is a continuation of U.S. patent application Ser. No. 16/929,097, filed on Jul. 14, 2020, which is a continuation-in-part of U.S. patent application Ser. No. 15/068,868, filed on Mar. 14, 2016 and issued as U.S. Pat. No. 10,709,220 on Jul. 14, 2020, which claims the benefit of U.S. Provisional Patent Application Ser. No. 62/132,002, filed on Mar. 12, 2015; the entireties of which are hereby incorporated herein by reference.

BACKGROUND

Field of the Invention

The present disclosure relates to user removable protective cases and enclosures for mobile electronic devices.

Description of the Related Art

Mobile electronic devices, such as smartphones, tablets, laptops, and the like are known to sustain damage from impact and from contamination as a result of the ingress of water or other fluids. Such damage may result, for example, in a cracked screen, scratches on a finished surface, lost or damaged buttons or controls, cracked or bent external body components, and/or failed or malfunctioning electrical components. Protective cases can protect mobile electronic devices from such damage and other types of damage.

SUMMARY

A protective case for a mobile electronic device having a touchscreen is disclosed herein.

In a first set of embodiments, including the first, second, and third embodiments described below, the case includes a back frame that receives the mobile electronic device, a stretchable cover that stretches over at least a portion of the back frame and the mobile electronic device when the mobile electronic device is in the back frame, and a front frame that has a transparent screen protector that mounts over a portion of the stretchable cover and the back frame such that the mobile electronic device is held between the back frame and the front frame.

The back frame has an open front and is shaped to receive the mobile electronic device. Openings are provided in the back frame for any controls or outputs of the device that are covered by the back frame. The back frame may preferably be a unitary molded piece that has a screened portion formed in a microphone opening that protects the microphone. The back frame includes a camera flap cavity with sidewalls on an exterior of the back frame that receives a hinged camera flap which removably covers and seals the camera flap cavity. The back frame also includes compression pad cavities on an interior surface of the back frame and compression pads mounted in the compression pad cavities. The compression pads ensure a tight compression fit between the case and a mobile electronic device retained therein. The back frame includes an opening that allows a user to remove the mobile electronic device from the back frame by pushing on the back of the device. Raised portions on the back frame extend through openings in the back of the stretchable cover to restrict movement of the stretchable cover with respect to the back frame.

The stretchable cover is constructed so that it can be stretched over the back frame when the device is mounted in the back frame. The cover has tabs and flaps that correspond to the control openings in the back frame and function to removably cover the controls and outputs of the device. When installed over the back frame, the stretchable cover has portions that extend over the mobile electronic device mounted in the back frame. These portions of the stretchable cover ensure that the mobile electronic device is securely held inside the back frame and stretchable cover.

The stretchable cover includes a recessed front portion that is shaped to receive the front frame when the front frame is mounted on the cover and back frame. The front frame fits in the recessed front portion and clamps over the cover and back frame such that the mobile electronic device is securely held between the back frame and the front frame and the touchscreen of the mobile electronic device is protected and usable while the device is in the case. The stretchable cover also preferably includes bumper portions around the recessed front portion that extend past a front surface of the front frame when the case is assembled and that cushion the case in the event of an impact.

The front frame is preferably coupled to the back frame with grasping protrusions that mate with corresponding mounting portions on the back frame which extend through openings in the stretchable cover. The front frame also preferably has a front frame control opening and the stretchable cover includes a button pad that extends through the control opening. The flexible button pad forms a seal with the rigid front frame control opening and allows a control on the front of the mobile electronic device to be operated when the mobile electronic device is inside the case. The front frame also preferably includes a speaker opening having a water-resistant insert and a camera opening with a transparent camera cover.

The transparent screen protector may preferably be mounted on a raised portion on the back of the front frame. The stretchable cover has a corresponding front cavity shaped to receive the raised portion of the front frame and screen protector and form a debris-resistant seal.

In a second set of embodiments, including the fourth and fifth embodiments described below, the protective case includes a back frame and a front cover. The back frame includes a rigid plastic back frame having an elastomeric material bonded to portions of the rigid plastic back frame. The elastomeric material bonded to portions of the rigid plastic back frame forms a series of raised bumpers around the exterior surfaces of the protective case. Back frame engagement members are positioned on the perimeter of the rigid plastic back frame.

An elastomeric insert is positioned around at least a portion of an interior perimeter of the back frame. The elastomeric insert has a plurality of compressible structures that provide impact cushioning for a mobile electronic device enclosed in the protective case. The elastomeric insert also includes flexible button cover portions that allow the controls of the mobile electronic device to be used while the mobile electronic device is enclosed within the protective case.

The front cover mates with the back frame to enclose the elastomeric insert and the mobile electronic device. The front cover includes a touchscreen cover and a rigid plastic front frame bonded to the perimeter of the touchscreen cover. The front cover also includes an opening in the touchscreen cover that corresponds to a location of a device control when the protective cover is installed over the device and a flexible membrane that covers the opening. Front cover engagement members extend from the rigid plastic front frame. The front cover engagement members engage the back frame engagement members on the plastic back frame to hold the front frame on the back frame and enclose the mobile electronic device. The front frame engagement members extend down from the rigid plastic front frame and are positioned around an exterior perimeter of the mobile electronic device. The front engagement members may be protrusions extending from the front cover having hooked lips. The extended portions of the front cover snap into the corresponding back frame engagement members to secure the front cover to the back frame and enclose the mobile electronic device. The front cover includes a removal tab that facilitates removal of the front cover from the back frame.

In some alternative embodiments within the second set of embodiments, the front cover slides over the back frame and over the elastomeric insert to form the protective case and enclose the mobile electronic device. In such embodiments, the front cover engagement members are extended portions positioned around the perimeter of the front cover and the back frame engagement members are overhanging portions of the back frame. The extended portions of the front cover slide under the overhanging portions of the back cover to secure the front cover to the back frame and enclose the mobile electronic device with the protective case.

Each of the foregoing and various aspects, together with those set forth in the claims and summarized above or otherwise disclosed herein, including the figures, may be combined without limitation to form claims for a device, apparatus, system, method of manufacture, and/or method of use.

BRIEF DESCRIPTION OF THE DRAWINGS

The figures provided herewith are intended to illustrate but not to limit the invention. Like reference characters in the figures denote corresponding features consistently throughout similar embodiments.

DETAILED DESCRIPTION OF THE ILLUSTRATED EMBODIMENTS

Figure 1:
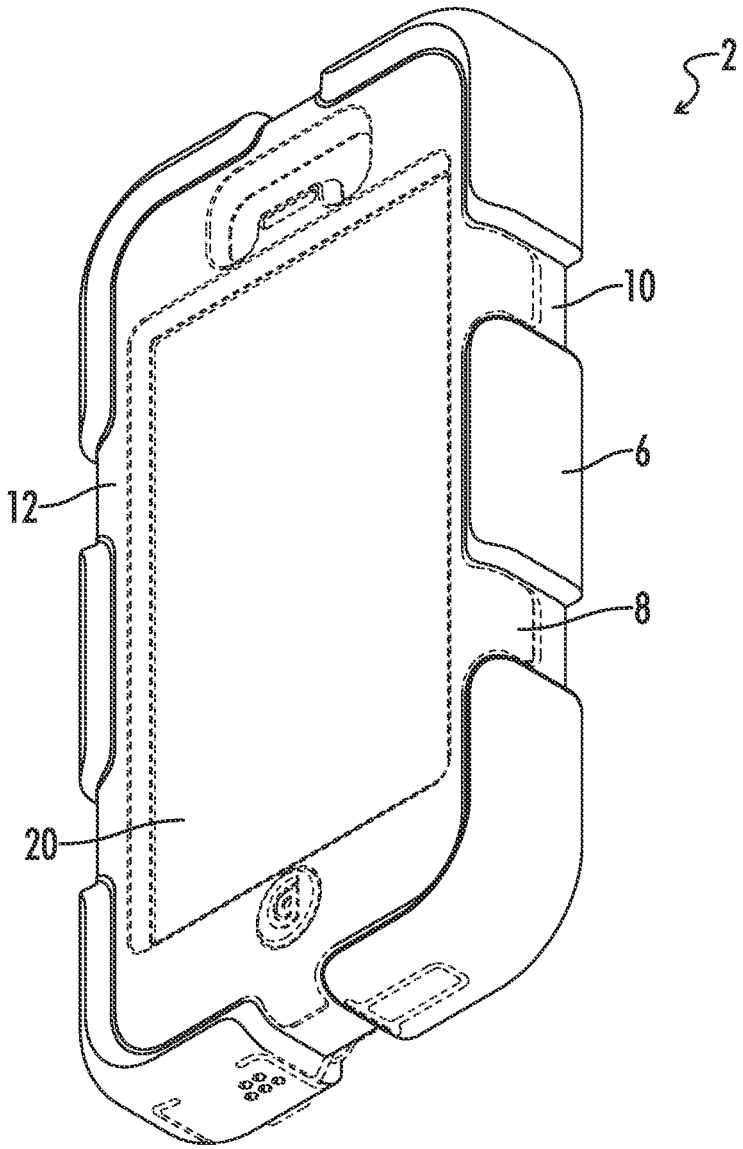
FIG. 1 illustrates an embodiment of the disclosed case configured for a mobile phone with a mobile phone retained therein.

A protective case for a mobile electronic device having a touchscreen is disclosed herein.

In a first set of embodiments, including the first, second, and third embodiments described below, the case includes a back frame that receives the mobile electronic device, a stretchable cover that stretches over at least a portion of the back frame and the mobile electronic device when the mobile electronic device is in the back frame, and a front frame that has a transparent screen protector that mounts over a portion of the stretchable cover and the back frame such that the mobile electronic device is held between the back frame and the front frame.

The back frame has an open front and is shaped to receive the mobile electronic device. Openings are provided in the back frame for any controls or outputs of the device that are covered by the back frame. The back frame may preferably be a unitary molded piece that has a screened portion formed in a microphone opening that protects the microphone. The back frame includes a camera flap cavity with sidewalls on an exterior of the back frame that receives a hinged camera flap which removably covers and seals the camera flap cavity. The back frame also includes compression pad cavities on an interior surface of the back frame and compression pads mounted in the compression pad cavities. The compression pads ensure a tight compression fit between the case and a mobile electronic device retained therein. The back frame includes an opening that allows a user to remove the mobile electronic device from the back frame by pushing on the back of the device. Raised portions on the back frame extend through openings in the back of the stretchable cover to restrict movement of the stretchable cover with respect to the back frame.

The stretchable cover is constructed so that it can be stretched over the back frame when the device is mounted in the back frame. The cover has tabs and flaps that correspond to the control openings in the back frame and function to removably cover the controls and outputs of the device. When installed over the back frame, the stretchable cover has portions that extend over the mobile electronic device mounted in the back frame. These portions of the stretchable cover ensure that the mobile electronic device is securely held inside the back frame and stretchable cover.

The stretchable cover includes a recessed front portion that is shaped to receive the front frame when the front frame is mounted on the cover and back frame. The front frame fits in the recessed front portion and clamps over the cover and back frame such that the mobile electronic device is securely held between the back frame and the front frame and the touchscreen of the mobile electronic device is protected and usable while the device is in the case. The stretchable cover also preferably includes bumper portions around the recessed front portion that extend past a front surface of the front frame when the case is assembled and that cushion the case in the event of an impact.

The front frame is preferably coupled to the back frame with grasping protrusions that mate with corresponding mounting portions on the back frame which extend through openings in the stretchable cover. The front frame also preferably has a front frame control opening and the stretchable cover includes a button pad that extends through the control opening. The flexible button pad forms a seal with the rigid front frame control opening and allows a control on the front of the mobile electronic device to be operated when the mobile electronic device is inside the case. The front frame also preferably includes a speaker opening having a water-resistant insert and a camera opening with a transparent camera cover.

The transparent screen protector may preferably be mounted on a raised portion on the back of the front frame. The stretchable cover has a corresponding front cavity shaped to receive the raised portion of the front frame and screen protector and form a debris-resistant seal.

In a second set of embodiments, including the fourth and fifth embodiments described below, the protective case includes a back frame and a front cover. The back frame includes a rigid plastic back frame having an elastomeric material bonded to portions of the rigid plastic back frame. The elastomeric material bonded to portions of the rigid plastic back frame forms a series of raised bumpers around the exterior surfaces of the protective case. Back frame engagement members are positioned on the perimeter of the rigid plastic back frame.

An elastomeric insert is positioned around at least a portion of an interior perimeter of the back frame. The elastomeric insert has a plurality of compressible structures that provide impact cushioning for a mobile electronic device enclosed in the protective case. The elastomeric insert also includes flexible button cover portions that allow the controls of the mobile electronic device to be used while the mobile electronic device is enclosed within the protective case.

The front cover mates with the back frame to enclose the elastomeric insert and the mobile electronic device. The front cover includes a touchscreen cover and a rigid plastic front frame bonded to the perimeter of the touchscreen cover. The front cover also includes an opening in the touchscreen cover that corresponds to a location of a device control when the protective cover is installed over the device and a flexible membrane that covers the opening. Front cover engagement members extend from the rigid plastic front frame. The front cover engagement members engage the back frame engagement members on the plastic back frame to hold the front frame on the back frame and enclose the mobile electronic device. The front frame engagement members extend down from the rigid plastic front frame and are positioned around an exterior perimeter of the mobile electronic device. The front engagement members may be protrusions extending from the front cover having hooked lips. The extended portions of the front cover snap into the corresponding back frame engagement members to secure the front cover to the back frame and enclose the mobile electronic device. The front cover includes a removal tab that facilitates removal of the front cover from the back frame.

In some alternative embodiments within the second set of embodiments, the front cover slides over the back frame and over the elastomeric insert to form the protective case and enclose the mobile electronic device. In such embodiments, the front cover engagement members are extended portions positioned around the perimeter of the front cover and the back frame engagement members are overhanging portions of the back frame. The extended portions of the front cover slide under the overhanging portions of the back cover to secure the front cover to the back frame and enclose the mobile electronic device with the protective case.

Figure 2:
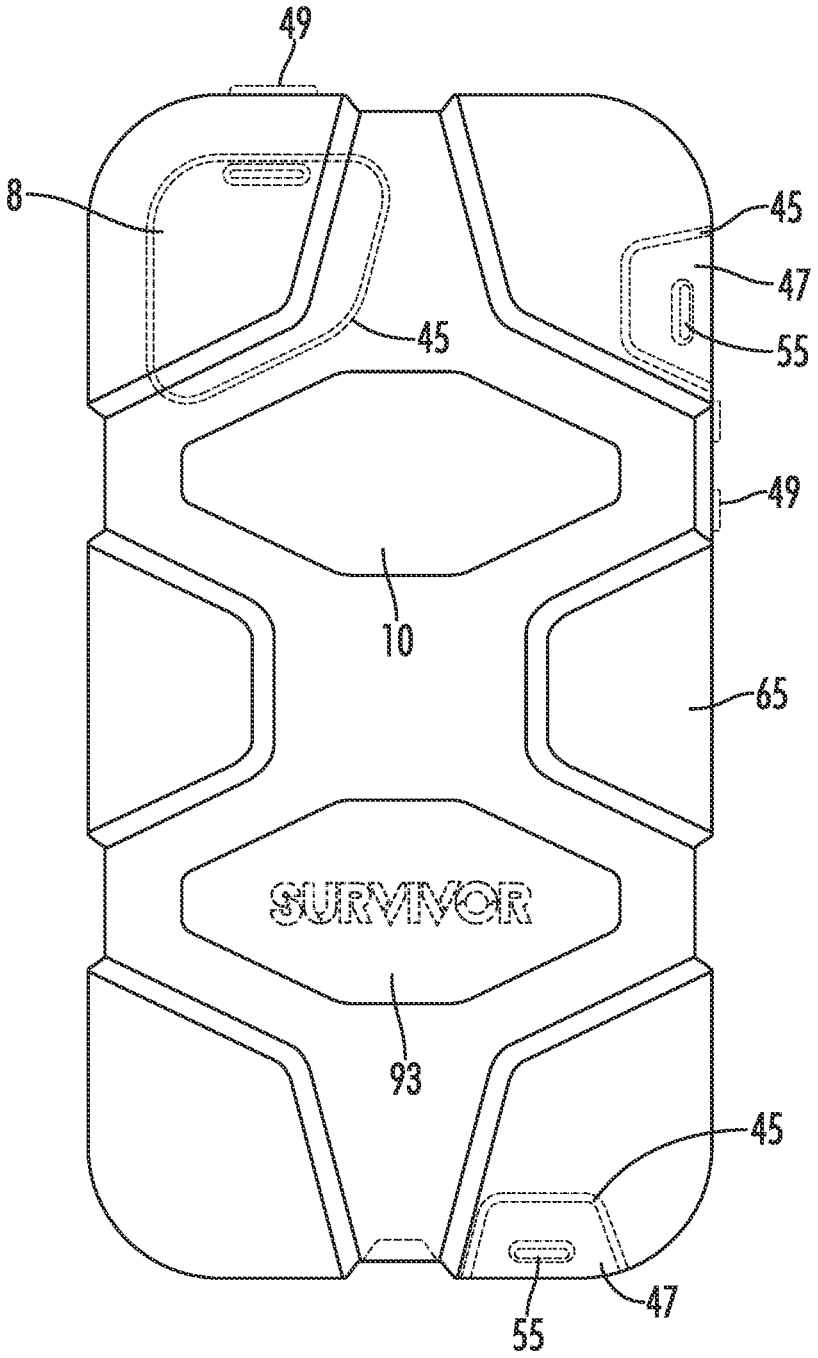
FIG. 2 is a back view of the embodiment of FIG. 1.
Figure 3:
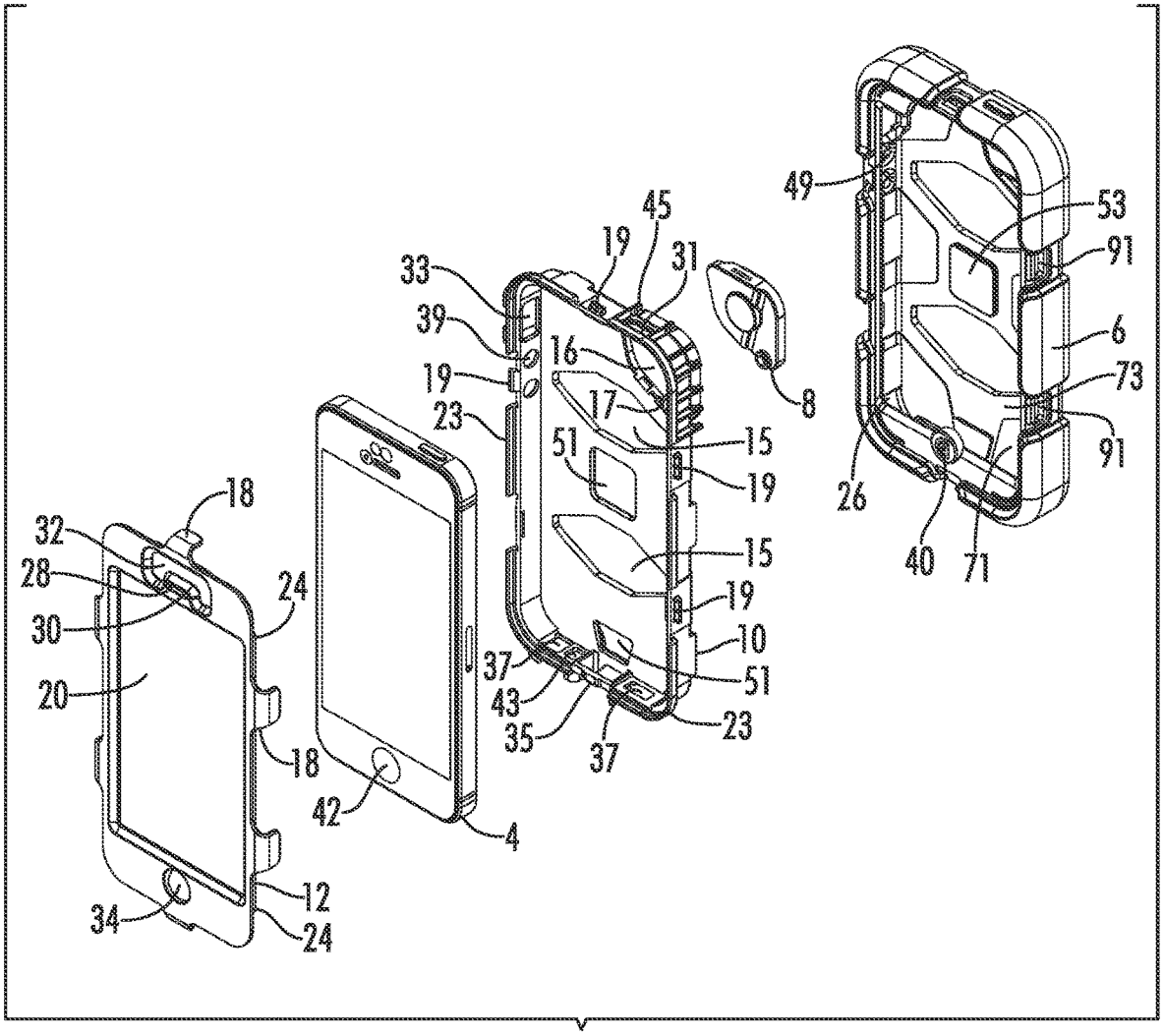
FIG. 3 is an exploded view of the embodiment of FIG. 1 showing a mobile phone that may be retained therein.

FIG. 1 is a front isometric view of a first embodiment of the disclosed case 2 in assembled form that is configured for a mobile phone 4. FIG. 2 is a back view of the embodiment of FIG. 1 and FIG. 3 is an exploded view of the embodiment of FIG. 1. FIGS. 4-7 illustrate the assembly of the embodiment of FIG. 1 from its components parts.

Figure 4:
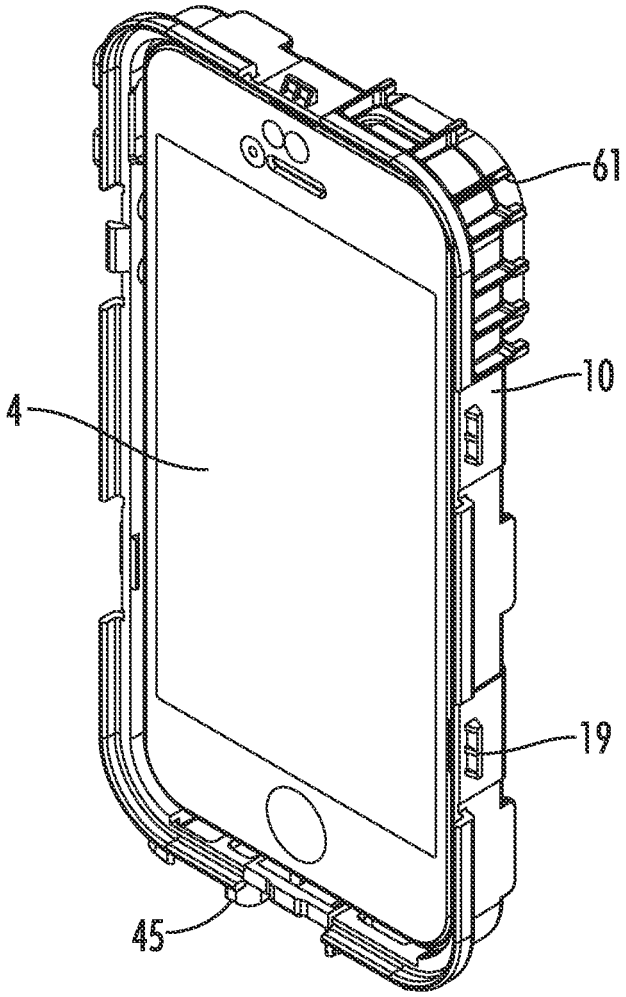
FIG. 4 is an illustration of the back frame of the embodiment of FIG. 1 with a mobile phone inserted into the back frame.
Figure 5:
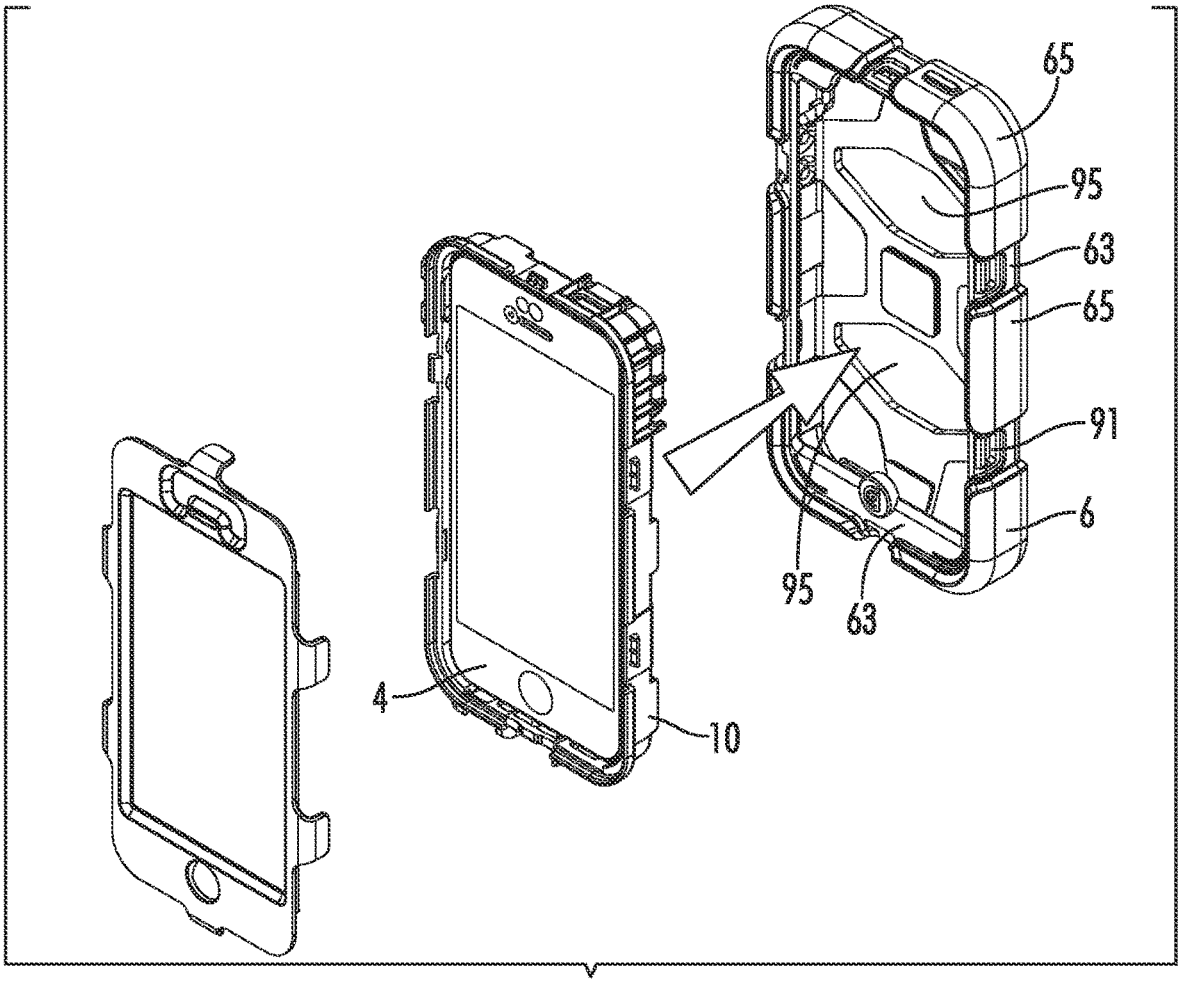
FIG. 5 is an illustration of the insertion of the back frame of the embodiment of FIG. 1 into the stretchable cover while a mobile phone is positioned in the back frame.
Figure 6:
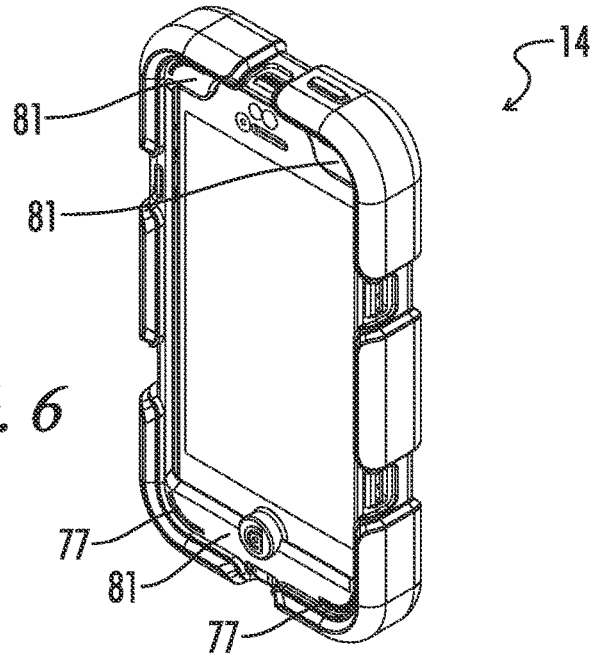
FIG. 6 is an illustration of the back frame of the embodiment of FIG. 1 inserted into the stretchable cover with a mobile phone held inside.
Figure 7:
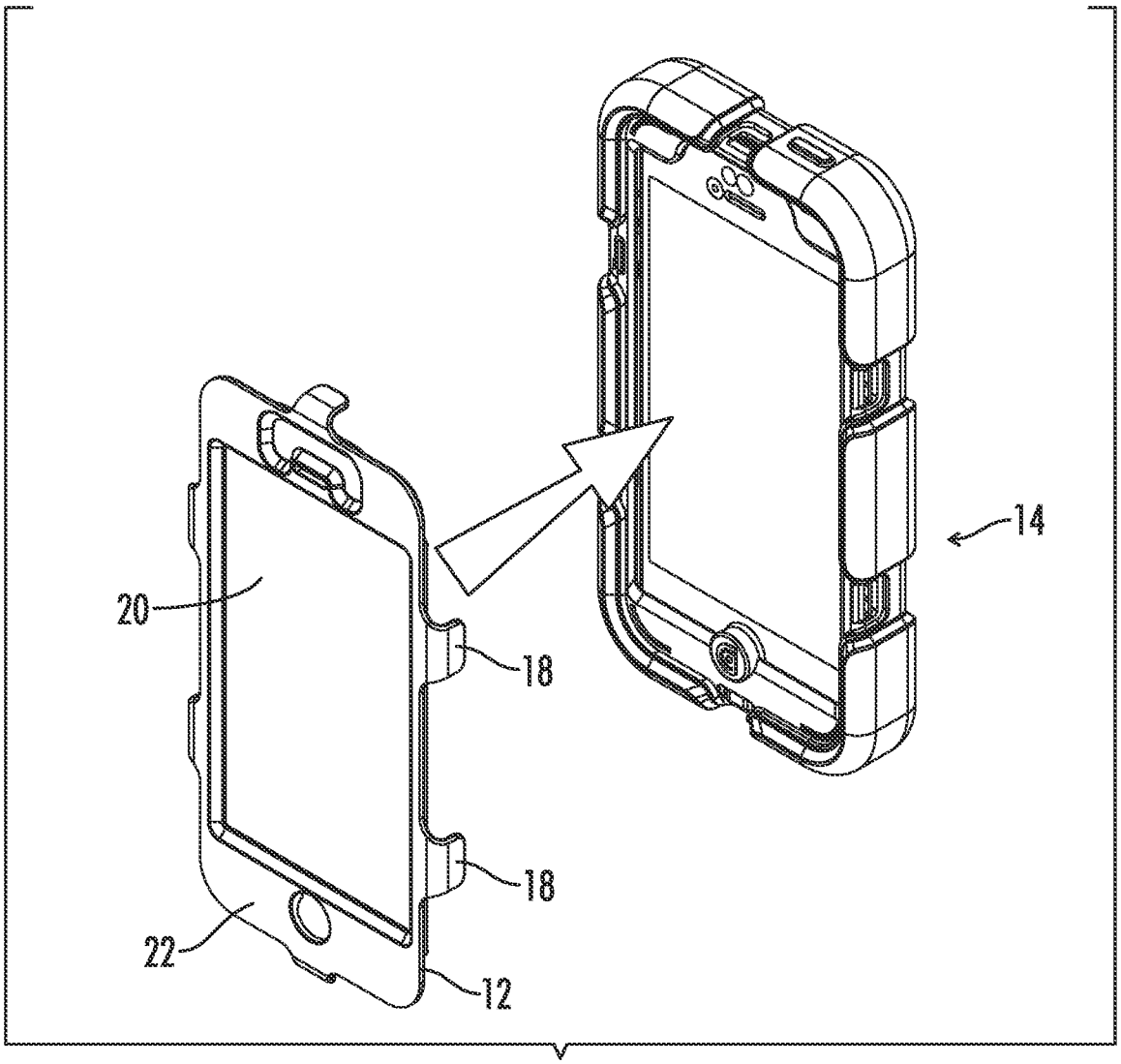
FIG. 7 is an illustration of the clamping of the front frame over the back frame and the stretchable rear cover of the embodiment of FIG. 1 with a mobile phone enclosed therein.

The protective device case 2 is preferably constructed from three basic components: a rear stretchable silicone rubber cover 6, a rigid plastic back frame 10, and a rigid plastic front frame 12. The embodiment shown in FIGS. 1-7 also has a camera cover 8 to accommodate a digital camera on the back of the enclosed mobile phone 4. To assemble the case 2, the camera cover 8 is inserted into a shaped camera flap opening 16 in the rigid rear frame 10. The mobile phone 4 is then inserted into the back frame 10 as shown in FIG. 4. Next, as shown in FIG. 5, the rigid back frame 10 with the mobile phone 4 inserted inside is further inserted into the stretchable silicone rubber cover 6 which stretches over the rear frame 10 such that the mobile phone 4 is firmly held inside the rear frame 10 and a unitary assembly 14 is formed as shown in FIG. 6. Finally, the front frame 12 is clamped over the rear frame and stretchable cover assembly 14 with the mobile phone inside as shown in FIG. 7 such that the phone is firmly and securely held inside the completely assembled case 2.

In the embodiment shown in FIGS. 1-7, the front frame 12 is coupled to the rear frame 10 by six grasping protrusions 18 that extend from the sides of the front frame 12. The front frame 12 is preferably constructed from a unitary, rigid plastic frame 22 with a transparent screen protector 20 bonded to the frame. The screen protector 20 is mounted on a slightly raised portion 24 on the back of the front frame 12. The raised portion 24 on the back of the front frame 12 tightly fits into a corresponding front opening 26 in the stretchable cover 6 such that a debris- and moisture-resistant seal is created between the stretchable cover 6 and the front frame 12. The screen protector 20 is preferably bonded to the front frame 12 around its entire periphery such that a water-tight seal is formed between the protector and the front frame. A protective speaker cover 28 that allows sound to pass relatively unobstructed is mounted in an opening 30 in the front frame 12 and screen protector 20 to allow a user to hear sound from the mobile phone's microphone while the mobile phone 4 is in the case. An opening 32 in the front frame 12 with a transparent cover is also provided for a camera on the front of the mobile phone 4. Those skilled in the art will appreciate that the precise location and configuration of the speaker, control and camera openings will vary based upon the type of device that the case is designed to enclose.

As best shown in FIG. 3, an opening 34 in the front frame 12 is provided for a control button 42 on the front of the mobile phone 4. The stretchable silicone cover 6 includes a button pad 40 that fits through the opening 34 in the front frame 12. The button pad 40 protects the control button 42 on the front of the phone while allowing it to be used when the phone is enclosed within the case. In addition, the compression fit between the front frame 12 and the back frame 10 creates a protective, debris-resistant seal between the relatively rigid button opening 34 and the flexible button pad 40.

The front frame 12 preferably has six grasping protrusions 18 that engage six mating portions 19 on the back frame 10. The protrusions 18 preferably have a snap fit that firmly secures the front frame 12 to the mating portions 19 of the back frame 10 but may be easily removed by a user engaging the protrusions with a fingernail. In the embodiment shown in FIGS. 1-7, this is accomplished with a ridge on the inner surface of the protrusions 18 that engages the mating portions 19 on the back frame 10.

The back frame 10 includes a variety of openings for the controls of the mobile phone 4. These openings include an opening 16 for the camera on the back of the mobile phone 4 and an opening 41 for the camera flap hinge, the power switch 31, the input/output connector 35, two bottom microphones 37, up/down volume buttons 39, the headphone jack 43, and the ringer on/off 33. The openings in the rigid back frame 10 that have corresponding plugs 47 or flap covers in the stretchable cover 6 preferably have raised walls 45 surrounding sections of their perimeters that form cavities that receive the corresponding plugs 47 on the stretchable cover 6 to form removable or rotatable covers over the openings that increase their moisture and debris resistance while allowing access to the phone controls underneath. Pads 49 are provided on the interior and exterior of the stretchable cover 6 to assist with activating the control buttons through the stretchable cover. Finger grips 55 are provided on the flaps 47 to assist in their opening.

The back frame 10 includes openings 51 on the back that receive raised portions 53 on the stretchable cover 6. The openings 51 interact with the raised portions 53 to minimize movement of the stretchable cover 6 with respect to the back frame 10. In addition, the openings 51 assist in removing the mobile phone 4 from the back frame 10 when disassembling the case 2. A user can simply insert a finger into the openings 51 to apply pressure to the back of the mobile phone 4 which causes the mobile phone to be separated from the back frame 10, which is preferably precisely sized to form a relatively tight fit with the phone.

Compressible pads are positioned in shaped cavities 15 formed in the back frame 10 when the case is manufactured. The compressible pads ensure that a mobile phone is firmly held in the case by compression when the mobile phone is inserted into the back frame and apply pressure to the back of the phone which holds it firmly in place. The compressible pads 100 are best shown with respect to the embodiment of FIG. 8.

The back frame 10 also includes a mounting opening or cavity 16 that receives the camera flap 8. The camera flap 8 protects a digital camera positioned on the back of the mobile phone 4. The mounting cavity 16 includes a mounting hole 17 that is used to pivotally mount the hinged camera flap 8 so that it may be removed or rotated away from and over the back camera of the mobile phone 4.

Features such as ridges 61 that mate with corresponding cavities on the stretchable cover 6 are provided on the corner of the back frame 10 to further restrict movement of the back frame with respect to the stretchable cover.

The stretchable cover 6 is pulled over the back frame 10 with the mobile phone 4 inserted such that the mobile phone is held in place by the stretchable cover. The stretchable cover 6 has a sunken or recessed front portion 63 that corresponds to the shape of the front frame 12. The sunken front portion 63 of the stretchable cover 6 is surrounded by raised ridges that form bumpers 65 that protect the relatively rigid front frame 12 and cushion the case 2 if it is dropped. The interior of the stretchable cover 6 includes depressions 73 and raised portions 71 that correspond to depressions and raised portions on the back of the back frame 10 such that the stretchable cover grips and is fixed with respect to the rigid back frame. Channels on the underside of the stretchable cover 6 surrounding the front perimeter of the back frame 10 mate with corresponding raised extensions 23 on the front perimeter of the back frame 10 to secure the back frame with respect to the cover.

The stretchable cover includes a button pad 40 that fits through the opening 34 in the front frame 12. The button pad 40 protects the control button 42 on the front of the mobile phone while allowing it to be used when the mobile phone is enclosed within the case 2. In addition, the compression fit between the front frame 12 and the back frame 10 creates a water-resistant seal between the button opening 34 and the button pad 40.

The stretchable cover also has six openings 91, two on each side and one each on the top and bottom, that correspond to the grasping protrusions 18 on the front frame 12 and through which the mounting portions 19 on the back frame 10 extend.

Portions 81 of the stretchable cover 6 extend over the back frame 10 and the front of the mobile phone 4 when the mobile phone is mounted in the back frame and the stretchable cover is stretched over the mobile phone and back frame. These portions 81 hold the mobile phone in the back frame 10 and stretchable cover 6 when the front frame 12 is removed. This configuration allows the touchscreen of the phone to be cleaned and accessed without fully disassembling the case or removing the phone. Depressions, channels, grooves, or similar features 77 are provided on the portions of the stretchable cover that extend over the mobile phone. These features 77 mate with corresponding features on the underside of the front frame 12 to further secure the front frame to the stretchable cover 6.

Raised shapes 93 formed on the back of the back frame 10 extend through openings 95 in the stretchable cover 6. As well as adding to the visual appearance of the case, these features 93 and 95 help prevent the stretchable cover 6 from moving with respect to back frame 10. The stretchable cover 6 also includes raised portions 65 that extend beyond the back frame 10 to cushion the case in the event it is dropped. As shown in the embodiment of FIG. 2, the raised shapes 93 may be octagons.

Figure 8:
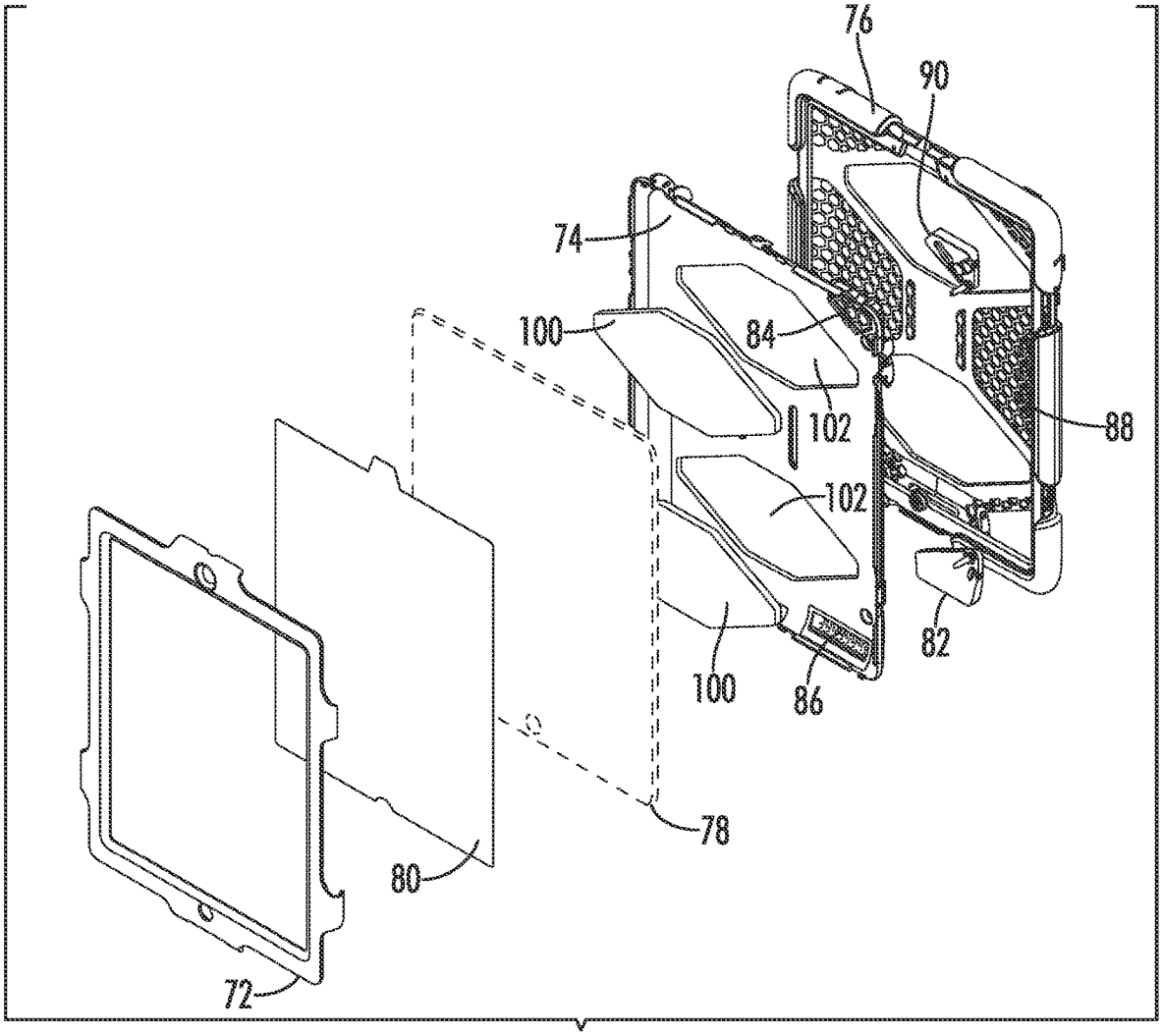
FIG. 8 is an exploded view of an embodiment of the disclosed case in unassembled form that is configured for a tablet computer.
Figure 9:
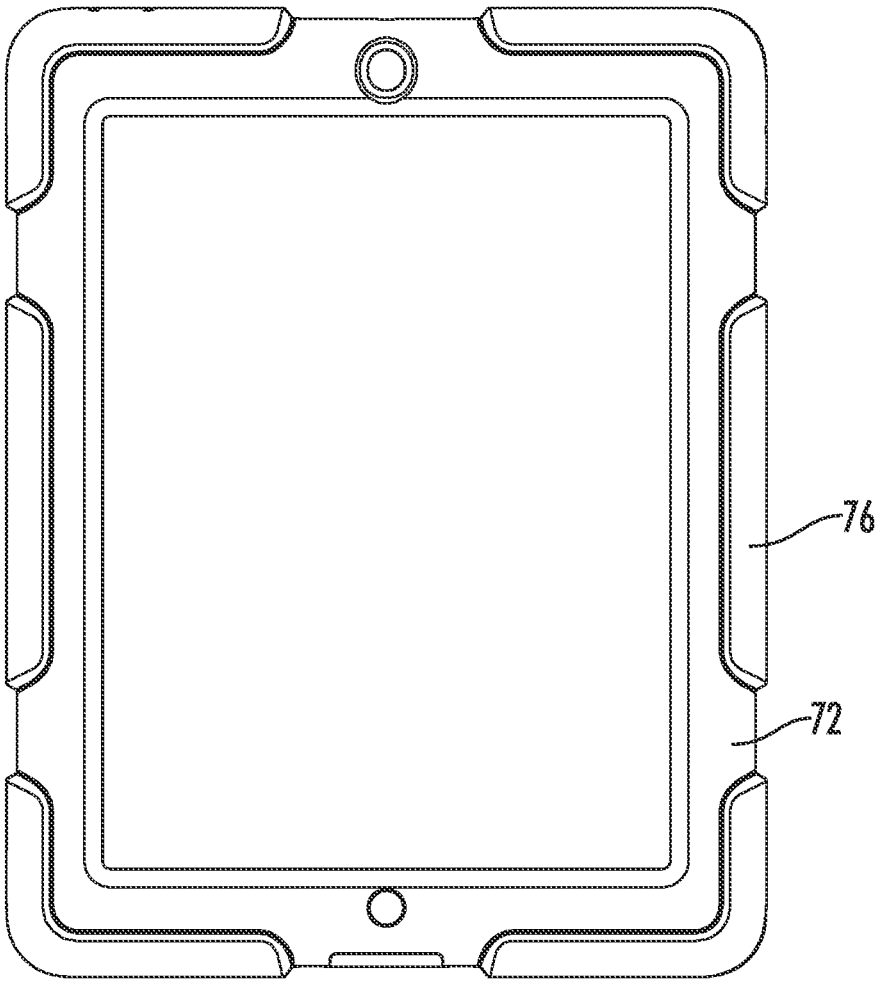
FIG. 9 is an illustration of a front view of the embodiment of FIG. 8 in assembled form.
Figure 10:
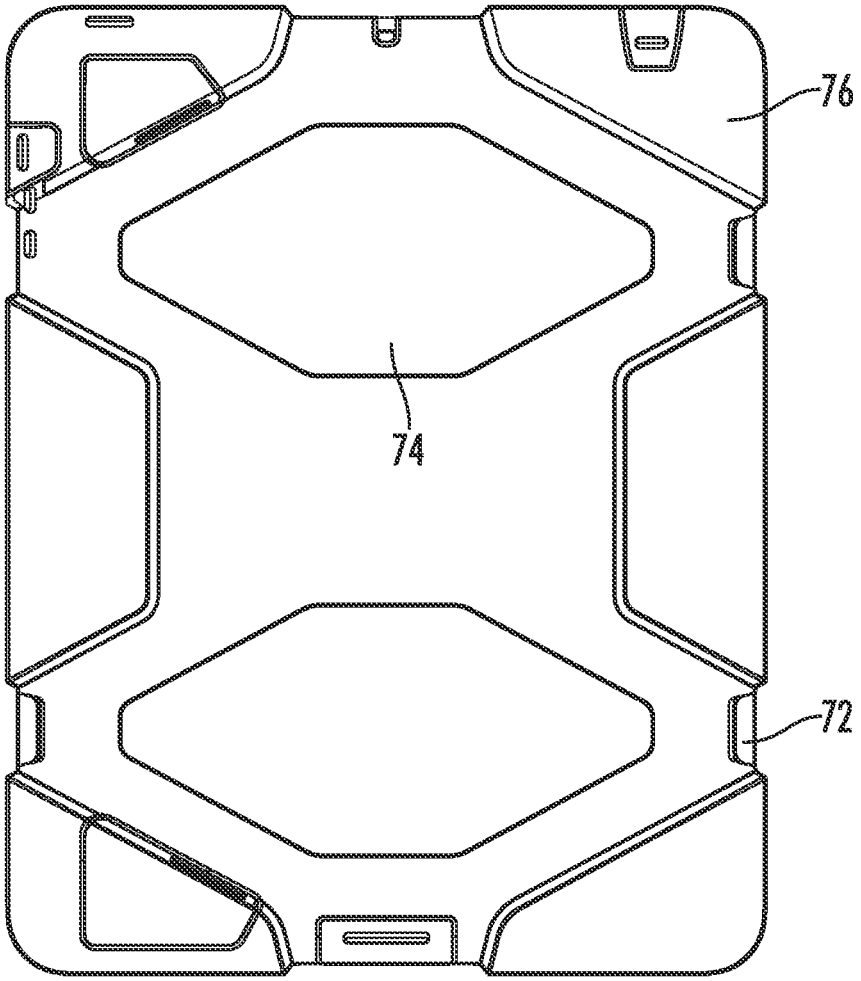
FIG. 10 is an illustration of a back view of the embodiment of FIG. 8 in assembled form.

FIG. 8, shows an exploded view of a second embodiment of the disclosed case in unassembled form that is configured for a tablet computer 78. FIG. 9 is an illustration of a front view of the embodiment of FIG. 8 in assembled form, and FIG. 10 is an illustration of a back view of the embodiment of FIG. 9. These figures demonstrate how the concepts of the disclosed case may be adapted for a variety of different types of devices. The case includes a front frame 72, back frame 74, and stretchable cover 76 which enclose the tablet computer 78. The touchscreen 80 is shown in FIG. 8 prior to being bonded to the raised portion on the back of the front frame 72 as discussed above with respect to the embodiment of FIG. 1.

The case has a hinged camera cover 90 that allows unobstructed access to the camera of the tablet 78 though an opening 84 in the back frame 74 while retaining the protective properties of the case. The tablet computer embodiment of the case shown in FIG. 7 also uses a hinged cover 82 for the larger speaker of the tablet computer 78 which is accessed through a screen 86 formed in the plastic of the single piece back frame 74.

Compressible pads 100 are positioned in trapezoidal cavities 102 formed in the back frame 74. The compressible pads 100 ensure that the tablet computer 78 fits securely in the case without moving by applying a constant pressure to a device installed in the case. The stretchable cover 76 also has a honeycomb structure of cavities 88 formed in its back section which increases the cushioning effect of the silicone rubber.

Figure 11:
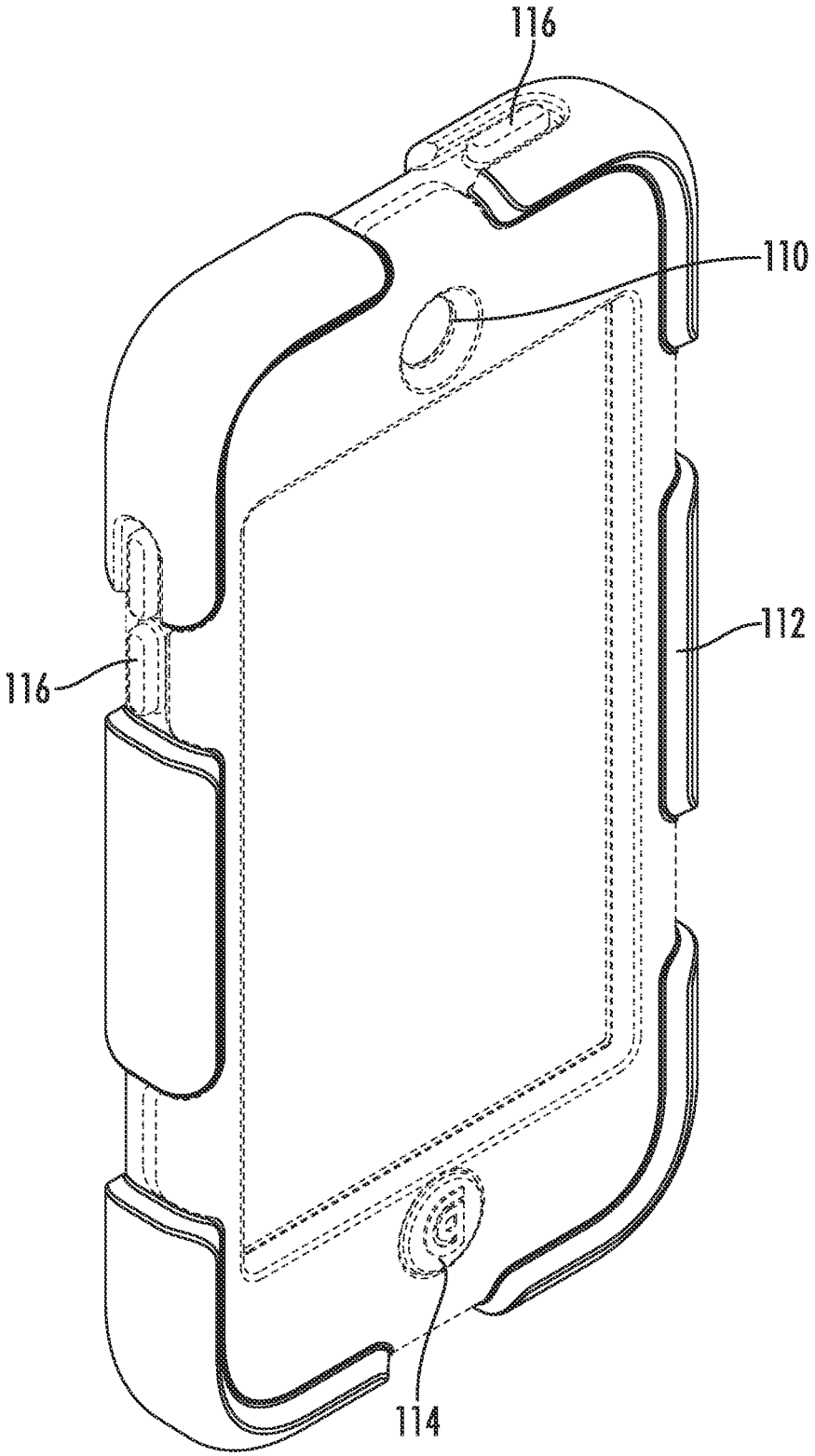
FIG. 11 is an isometric front view of an embodiment of the disclosed case in assembled form that is configured for a touchscreen digital music player.

FIG. 11 is an isometric front view of a third embodiment of the disclosed case in assembled form for a touchscreen digital music player. FIG. 11 further illustrates how aspects of the disclosed case such as the front frame camera opening 110, cover bumpers 112, front frame button opening and cover 114, and control covers 116 may be reconfigured to accommodate almost any particular device.

Figure 12:
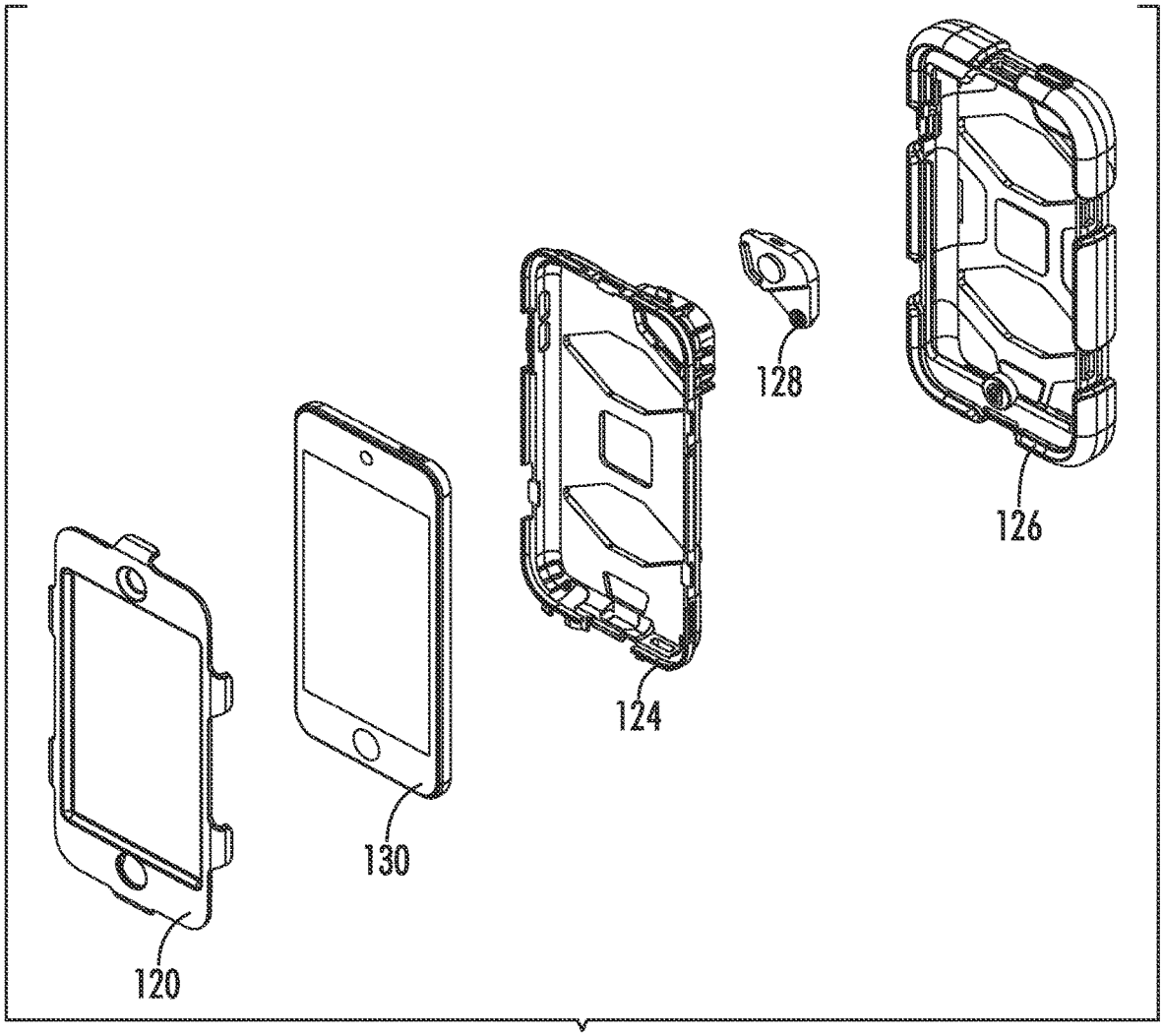
FIG. 12 is an exploded view of the embodiment of FIG. 1I in unassembled form.

FIG. 12 is an exploded view of the embodiment of FIG. 11 which illustrates the three main components of an unassembled device case for a touchscreen digital music player. The components include a back frame 124 that receives the digital music player 130, a stretchable cover 126 that stretches over the back frame 124 and digital music player 130, and a front frame 120 that clamps over the player, back frame, and cover. A hinged camera flap 128 that is mounted in the back frame 124 is also provided.

Figure 13:
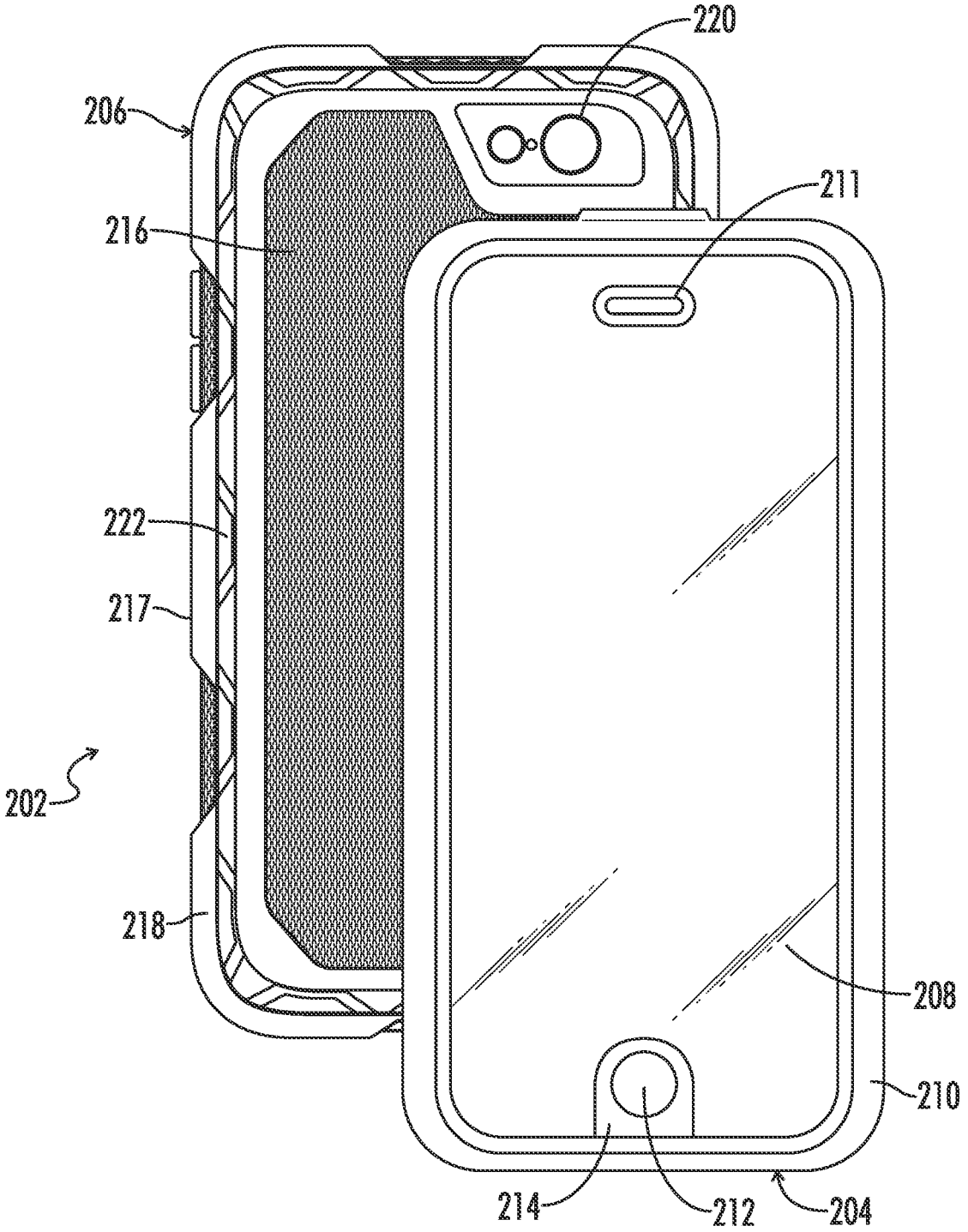
FIG. 13 is an illustration of an embodiment of the disclosed protective case in unassembled form.

FIG. 13 illustrates a fourth embodiment of the disclosed protective case 202 in unassembled form. The protective case has two primary pieces, a front cover 204 and a back frame 206. The front cover 204 has a touchscreen cover 208 bonded to a rigid plastic frame 210 that surrounds the perimeter of the touchscreen cover 208. The touchscreen cover 208 includes a speaker opening 211 and a button opening 212 covered by a flexible membrane 214 that allows the covered button to be operated. The back frame 206 includes a rigid plastic frame 216 with a flexible elastomeric layer 218 bonded over portions of the rigid plastic frame 216 to form cushioning bumpers 217. Preferably, the rigid plastic is a shatter-resistant polycarbonate that is clad in an elastomeric, rugged, shock-absorbing silicone. A camera opening 220 is provided in the rigid back frame 206 to allow the enclosed device's camera to be used while the device is enclosed within the protective case 202. An elastomeric insert 222 is positioned inside the back frame 206 around its perimeter to provide impact cushioning for the enclosed device.

Figure 14C:
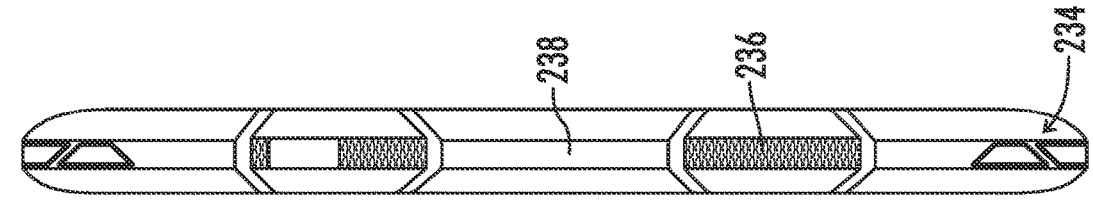
FIGS. 14A-14C are respectively back, front, and side views of the assembled protective case of FIG. 13.
Figure 14B:
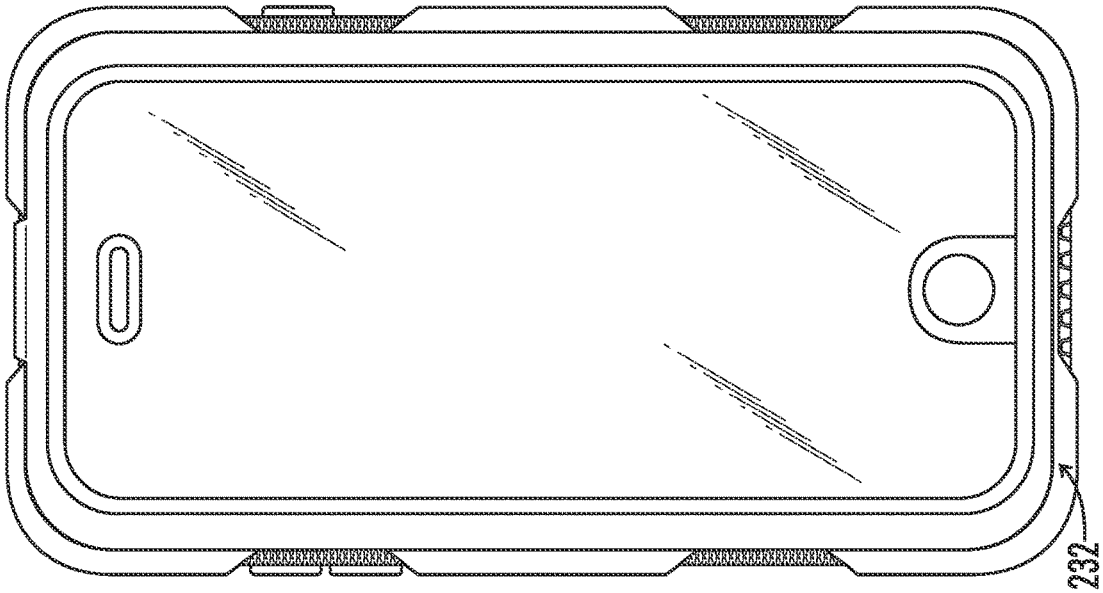
Figure 14A:
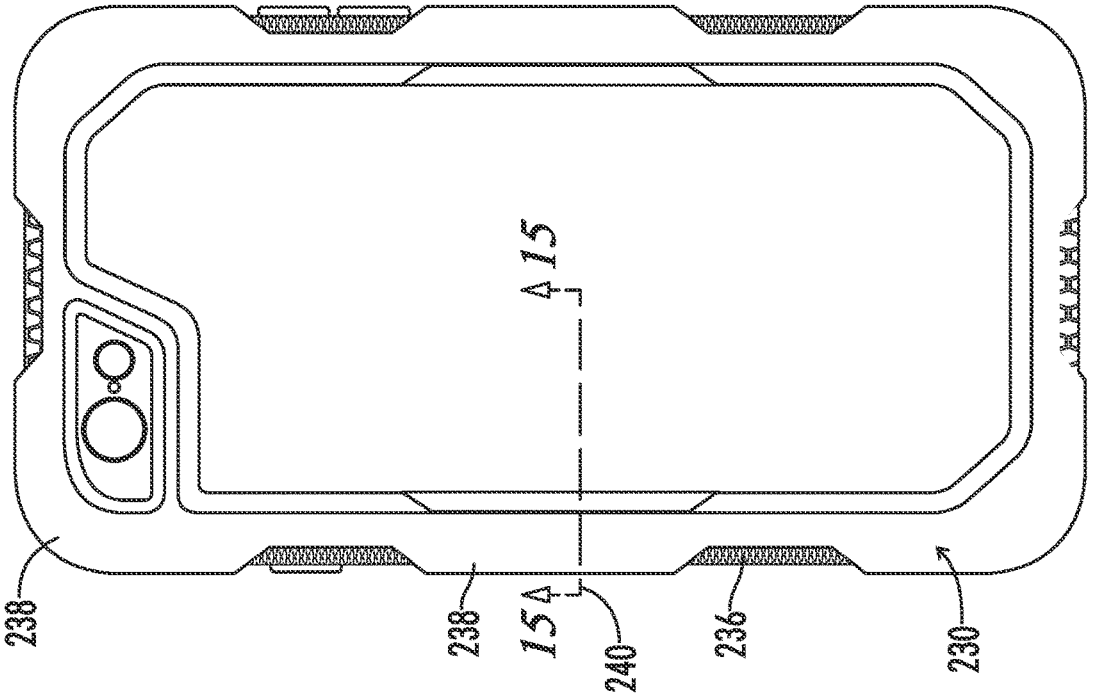

FIGS. 14A-14C illustrate back 230, front 232, and side views 234 of the assembled protective case of FIG. 13. As discussed above, alternating patches of exposed hard plastic 236 and elastomeric material 238 are bonded over the hard plastic 236 to form bumpers 238 around the edges of the case.

Figure 15:
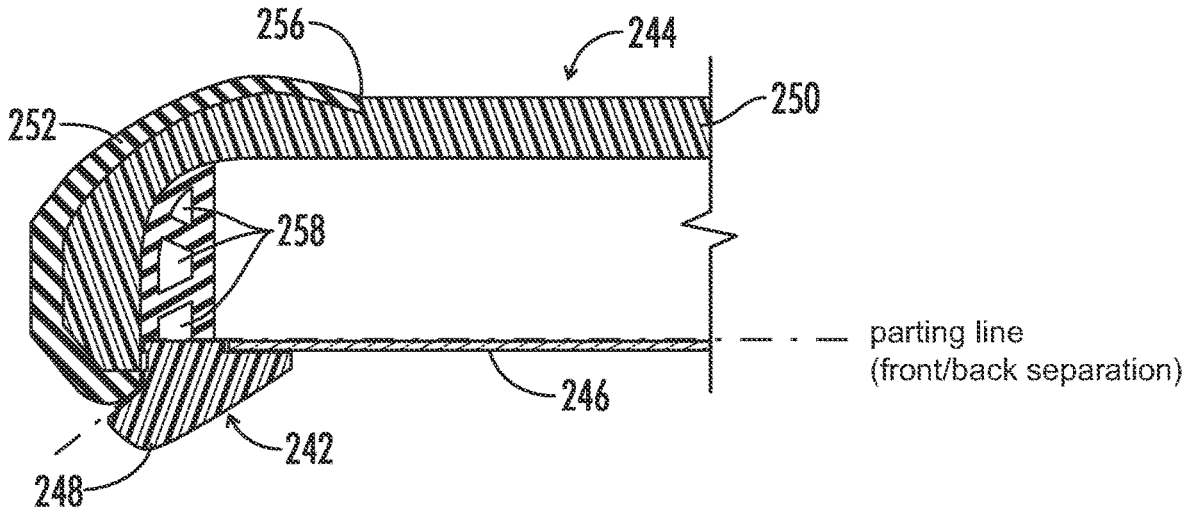
FIG. 15 is an illustration of a cross section of the assembled protective case of FIG. 13.

FIG. 15 illustrates a cross section of the assembled protective case of FIGS. 14A-14C along the line 240. The front cover 242 includes the touchscreen cover 246 bonded to the hard plastic perimeter 248. The back frame 244 has a rigid plastic frame 250 and elastomeric overlaid portions 252. An elastomeric insert 254 positioned in the back frame 244 has compressible cavities 258 that cushion an enclosed device from impact. Connectors such as snap connectors, discussed in more detail below, between the front cover 242 and back frame 244 compress the elastomeric insert 254 between the rigid plastic 248 of the front cover and the rigid plastic 250 of the back frame. The compression of the elastomeric insert 254 between rigid plastic of the front cover 242 and the back frame 244 creates a dust- and moisture-resistant seal that protects the electronic device held within the case. Grooves, cavities, and similar features 256 are provided on the hard plastic 248 of the back frame 244 to assist in securing the elastomeric portions 252 to the plastic.

Figure 16:
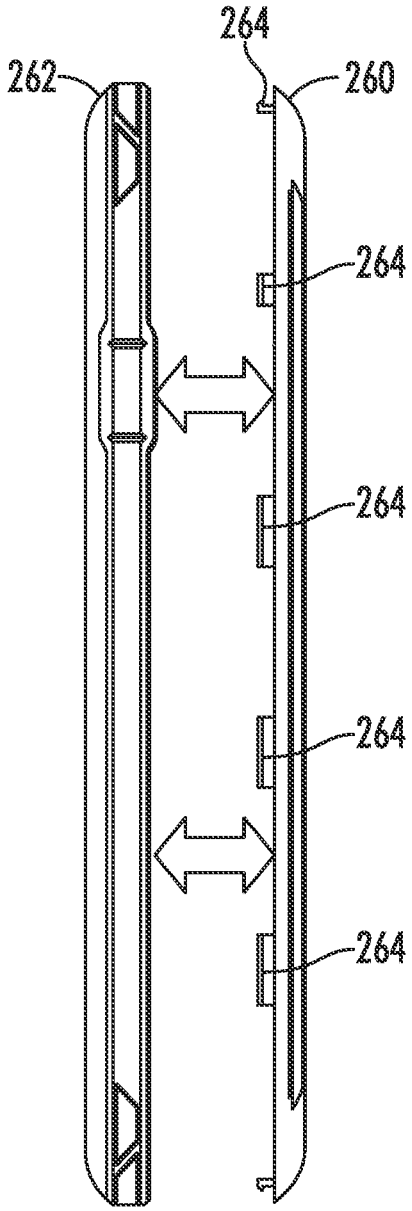
FIG. 16 is an illustration of the engagement of a front cover and back frame of an embodiment of the disclosed protective case.

FIG. 16 illustrates the engagement of a front cover 260 and back frame 262 of various embodiments of the disclosed protective case, such as the fourth embodiment illustrated in FIGS. 13-15. The snap connections are formed between extended protrusions 264 on the front cover 260 of the case that mate with corresponding features on the back frame 262. While snap connectors are preferred, a variety of other types of connectors well known in the art may alternatively be used.

Figure 17:
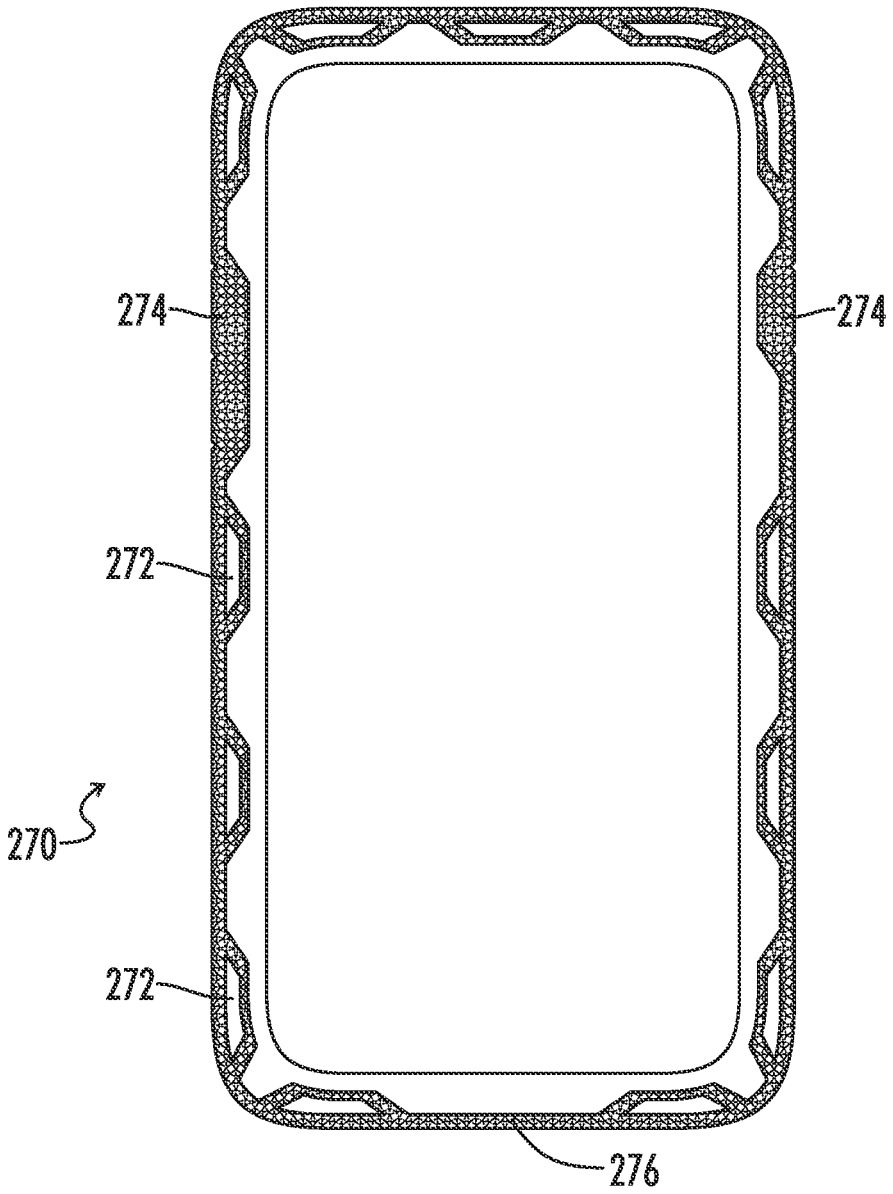
FIG. 17 is an illustration of an embodiment of an elastomeric insert having compressible structures for use in the disclosed protective case.

FIG. 17 illustrates an embodiment of a preferred elastomeric insert 270 having compressible structures 272 for use in various embodiments of the disclosed protective case, such as the fourth embodiment illustrated in FIGS. 13-15. The compressible structures 272 are positioned so that they surround the perimeter of the enclosed device. The elastomeric insert 270 has button covering portions 274 that correspond to the locations of the controls of the device. These flexible button covering portions 274 allow the controls of the enclosed device to be activated while the device is enclosed within the assembled case with its perimeter surrounded by the elastomeric insert 270. Openings 276 are provided in the elastomeric insert that allow external cables to be connected to the connectors of the device while the device is enclosed in the protective case. Those skilled in the art will appreciate that the location of the button covering portions 274 and the openings 276 will depend upon the configuration of the device for which the case is designed.

Figure 18:
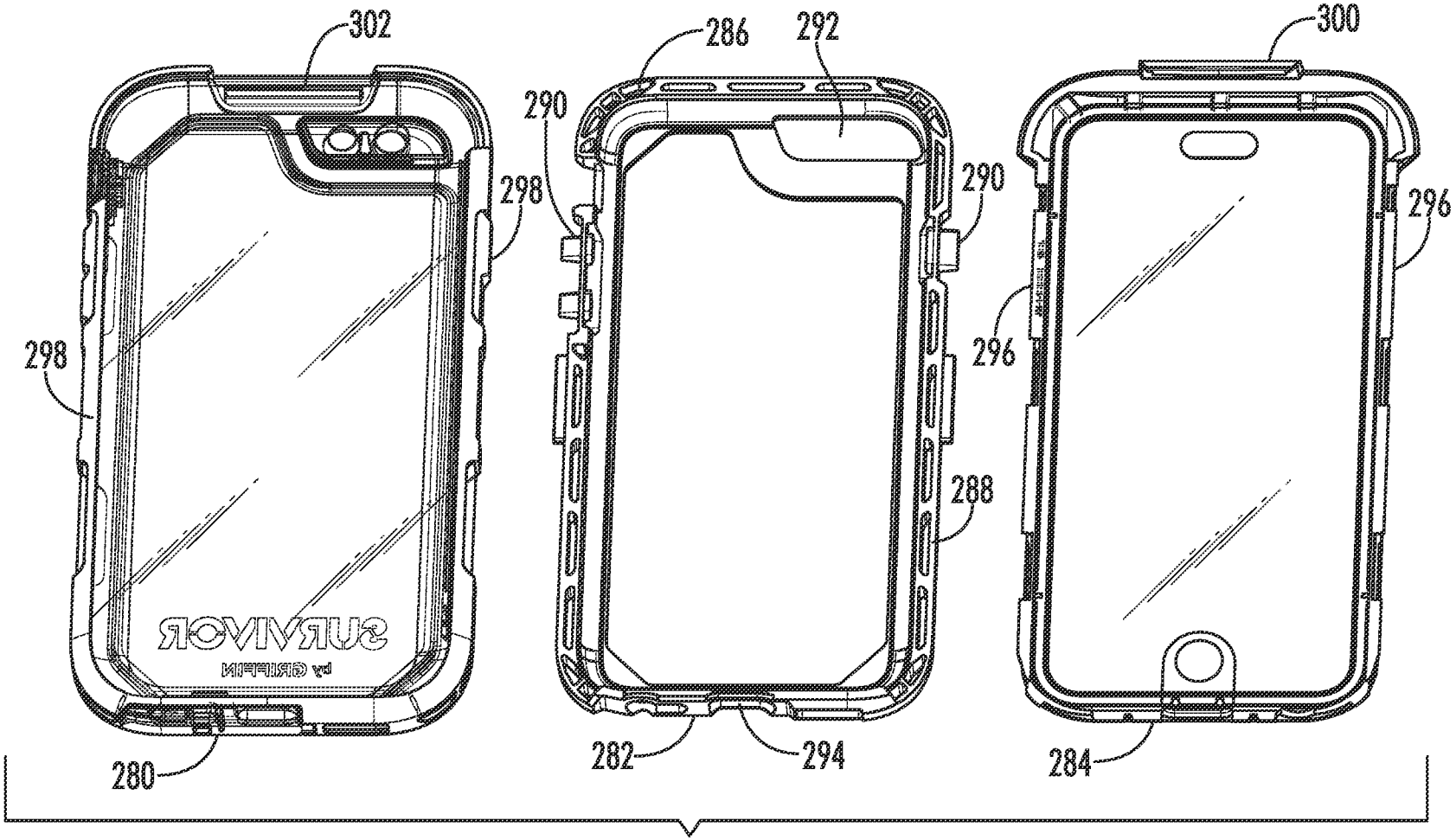
FIG. 18 is an illustration of an alternate embodiment of the disclosed protective case.
Figure 19:
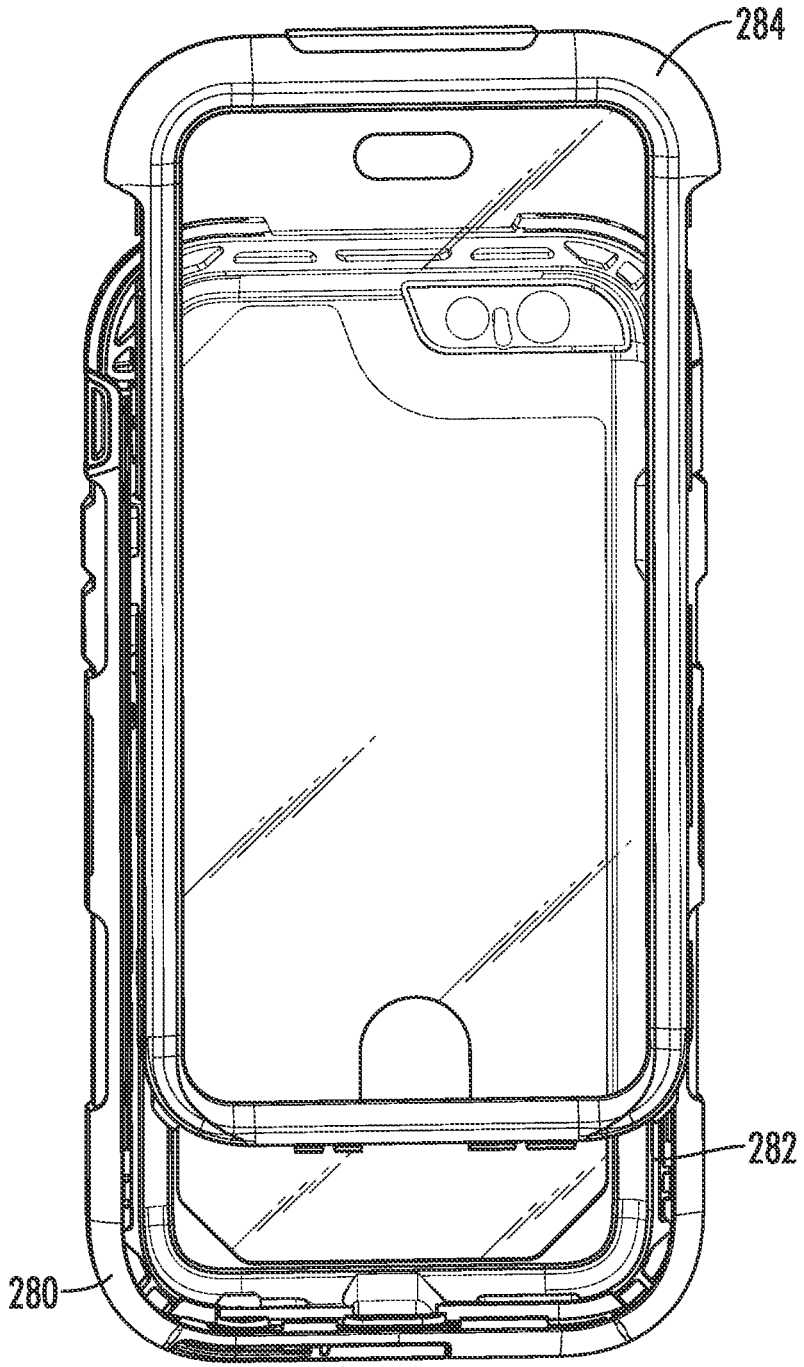
FIG. 19 is an illustration of the protective case of FIG. 18 showing the front cover being inserted over the back frame and elastomeric insert.

FIG. 18 illustrates a fifth embodiment of the disclosed protective case. In the embodiment shown, the case is assembled by placing the elastomeric insert 282 in the back frame 280, and sliding the front cover 284 over the back frame 280 and elastomeric insert 282. FIG. 19 is an illustration of the protective device case of FIG. 18 showing the front cover being inserted over the back frame and elastomeric insert. The elastomeric insert 282 has compressible structures 286 and 288 that increase the impact resistance of the case. Pads 290 are provided on the insert 282 that allow the controls of an enclosed device to be operated. Openings 294 in the elastomeric insert 282 allow external cable connections to an enclosed device. In the embodiment shown, the volume and power buttons of the device are covered, and hinged plugs seal the connectors, headphone port, and hold switch.

Extended portions 296 on the perimeter of the front cover 284 slide under overhanging portions 298 of the back frame 280 to secure the front cover to the back frame and enclose the mobile electronic device within the protective case. A locking extension 300 on the top of the front cover snaps onto a corresponding portion 302 on the top of the back frame when the front cover is fully inserted into the back frame to secure the front and back together. The locking extension 300 also functions as a finger grip that assists in the removal of the front cover from the back frame.

The previous description of the disclosed embodiments is provided to enable any person skilled in the art to make or use the invention disclosed herein. Although the various inventive aspects are disclosed in the context of certain illustrated embodiments, implementations, and examples, it should be understood by those skilled in the art that the invention extends beyond the specifically disclosed embodiments to other alternative embodiments and/or uses of the invention and obvious modifications and equivalents thereof. In addition, while a number of variations of various inventive aspects have been shown and described in detail, other modifications that are within their scope will be readily apparent to those skilled in the art based upon reviewing this disclosure. It should be also understood that the scope of this disclosure includes the various combinations or sub-combinations of the specific features and aspects of the embodiments disclosed herein, such that the various features, modes of implementation, and aspects of the disclosed subject matter may be combined with or substituted for one another. The generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

Similarly, the disclosure is not to be interpreted as reflecting an intent that any claim set forth below requires more features than are expressly recited in that claim. Rather, as the following claims reflect, inventive aspects may reside in a combination of fewer than all features of any single foregoing disclosed embodiment.

Each of the foregoing and various aspects, together with those set forth in the claims and summarized above or otherwise disclosed herein, including the figures, may be combined without limitation to form claims for a device, apparatus, system, method of manufacture, and/or method of use.

All references cited herein are hereby expressly incorporated by reference.

What is claimed is:

1. A protective case for a mobile electronic device, the protective case comprising:

a back frame having one or more mounting portions;

a stretchable cover having a button pad and configured to stretch over at least a portion of the back frame; and a front frame having an opening and one or more grasping protrusions;

wherein the front frame is configured to clamp over a portion of the stretchable cover and the back frame, wherein the stretchable cover has raised portions along one or more side exterior portions of the stretchable cover that extend beyond the back frame, wherein when the stretchable cover is stretched over the back frame and the front frame is clamped over the stretchable cover, the button pad of the stretchable cover fits in the opening of the front frame, wherein at least one grasping protrusion mates with the corresponding mounting portion, and wherein the one or more grasping protrusions do not extend beyond the dimensions of the back frame when the front frame is clamped over a portion of the stretchable cover and the back frame.

2. The protective case of claim 1, wherein the stretchable cover further comprises a mounting opening and the mounting portion on the back frame extends through the mounting opening.

3. The protective case of claim 1, wherein the back frame further comprises raised shapes formed on the back of the back frame and extending through openings in the stretchable cover, wherein the raised shapes are octagons.

4. The protective case of claim 1, wherein the back frame further comprises a cavity on an interior surface of the back frame and a compressible pad mounted in the cavity, wherein when a mobile electronic device is inserted into the back frame, the compressible pad applies pressure to the back of the mobile electronic device.

5. The protective case of claim 4, wherein the back frame further comprises a device opening that allows a user to remove the mobile electronic device from the back frame.

6. The protective case of claim 1, wherein the stretchable cover extends over a mobile electronic device when the mobile electronic device is mounted in the back frame and the stretchable cover is stretched over the back frame such that the mobile electronic device is held inside the back frame and stretchable cover.

7. The protective case of claim 1, wherein the back frame further comprises raised portions that extend through openings in a back of the stretchable cover that restrict movement of the stretchable cover with respect to the back frame.

8. The protective case of claim 1, wherein the back frame further comprises a screen formed in a microphone opening in the back frame.

9. The protective case of claim 1, wherein the front frame further comprises a speaker opening for a speaker, wherein the speaker opening has a water-resistant insert.

10. The protective case of claim 1, wherein the back frame is shaped to receive a mobile electronic device.

11. The protective case of claim 10, wherein the stretchable cover is configured to stretch over at least a portion of the back frame and the mobile electronic device when the mobile electronic device is mounted in the back frame.

12. The protective case of claim 1, wherein the front frame further comprises a transparent screen protector.

13. The protective case of claim 12, wherein the front frame further comprises a raised portion, and wherein the transparent screen protector is mounted on the raised portion.

14. The protective case of claim 13, wherein the stretchable cover further comprises a front cavity shaped to receive the raised portion of the front frame to form a water-resistant seal.

15. The protective case of claim 1, wherein the stretchable cover further comprises bumper portions that extend past a front surface of the front frame when the front frame is coupled to the back frame.

16. The protective case of claim 1, wherein the stretchable cover further comprises a recessed sunken front portion that is shaped to receive the front frame when the front frame is mounted on the back frame.

* * * * *